US008150289B2

(12) United States Patent
Yamashina et al.

(10) Patent No.: US 8,150,289 B2
(45) Date of Patent: Apr. 3, 2012

(54) FIXING DEVICE FOR AN IMAGE FORMING APPARATUS

(75) Inventors: Ryota Yamashina, Koganei (JP); Takeshi Yamamoto, Sagamihara (JP)

(73) Assignee: Ricoh Company Limited, Tokyo (JP)

( * ) Notice: Subject to any disclaimer, the term of this patent is extended or adjusted under 35 U.S.C. 154(b) by 372 days.

(21) Appl. No.: 12/477,351

(22) Filed: Jun. 3, 2009

(65) Prior Publication Data

US 2009/0297199 A1 Dec. 3, 2009

(30) Foreign Application Priority Data

Jun. 3, 2008 (JP) ..... 2008-145825
Feb. 16, 2009 (JP) ..... 2009-032526

(51) Int. Cl.
*G03G 15/20* (2006.01)

(52) U.S. Cl. ..... 399/70

(58) Field of Classification Search ..... 399/33, 399/69, 70, 328, 330; 219/216
See application file for complete search history.

(56) References Cited

U.S. PATENT DOCUMENTS

| | | | | |
|---|---|---|---|---|
| 5,747,774 | A * | 5/1998 | Suzuki et al. | 219/216 |
| 7,136,601 | B2 * | 11/2006 | Akizuki et al. | 399/69 |
| 7,349,642 | B2 * | 3/2008 | Tatematsu et al. | 399/69 |
| 7,379,685 | B2 * | 5/2008 | Tatematsu et al. | 399/69 |
| 2002/0061200 | A1 * | 5/2002 | Sakakibara et al. | 399/69 |
| 2004/0105693 | A1 | 6/2004 | Akizuki et al. | |
| 2006/0127112 | A1 | 6/2006 | Ono | |
| 2006/0257183 | A1 | 11/2006 | Ehara et al. | |

FOREIGN PATENT DOCUMENTS

| | | | |
|---|---|---|---|
| JP | 58-38972 | | 3/1983 |
| JP | 58038972 | A * | 3/1983 |
| JP | 60-163102 | | 8/1985 |
| JP | 3-116208 | | 5/1991 |
| JP | 03200185 | A * | 9/1991 |
| JP | 09152805 | A * | 6/1997 |
| JP | 9-258601 | | 10/1997 |
| JP | 2002296954 | A * | 10/2002 |
| JP | 2004341003 | A * | 12/2004 |
| JP | 2005215598 | A * | 8/2005 |
| JP | 2006-84961 | | 3/2006 |
| JP | 2006-195294 | | 7/2006 |
| JP | 2008-122757 | | 5/2008 |

OTHER PUBLICATIONS

Extended European Search Report issued Oct. 6, 2011, in Patent Application No. 09251475.1.

* cited by examiner

*Primary Examiner* — Robert Beatty
(74) *Attorney, Agent, or Firm* — Oblon, Spivak, McClelland, Maier & Neustadt, L.L.P.

(57) ABSTRACT

An image forming apparatus includes an imaging section and a thermal fixing device. The fixing device fuses a toner image formed by the imaging section onto the recording sheet passing through a fixing nip. The fixing device includes a fixing member, a pressure member, a heater, a temperature sensor, and a temperature controller. The fixing member is rotatable, and the pressure member is pressed against the fixing member to form the fixing nip therebetween. The heater heats at least a portion of the fixing member. The temperature sensor senses a temperature of the fixing member. The temperature controller controls the temperature of the fixing member in at least one of an on-off mode and a PID mode. The temperature controller initially operates in the on-off mode upon entering recovery, and switches to the PID mode when a threshold time has elapsed after entering recovery.

12 Claims, 10 Drawing Sheets

FIXING DEVICE FOR AN IMAGE FORMING APPARATUS

CROSS-REFERENCE TO RELATED APPLICATIONS

The present patent application claims priority pursuant to 35 U.S.C. §119 from Japanese Patent Application Nos. 2008-145825 and 2009-032526, filed on Jun. 3, 2008 and Feb. 16, 2009, respectively, the contents of each of which are hereby incorporated by reference herein in their entirety.

BACKGROUND OF THE INVENTION

1. Field of the Invention

The present invention relates to an image forming apparatus, and more particularly, to an electrophotographic image forming apparatus incorporating a thermal fixing device that fixes toner images onto recording media with a heated fixing member.

2. Discussion of the Background

In electrophotographic image forming apparatuses, such as printers, photocopiers, facsimiles, and multifunctional machines incorporating several of these functions, a fixing device is used to fix toner images in place on recording media such as sheets of paper. Typically, an electrophotographic fixing device includes a fixing member such as a belt or roller to receive recording media thereon, and a heater to heat the fixing member from within to fuse toner images onto the recording media, as well as a temperature controller to control operation of the heater by regulating power supplied thereto. In order to maintain a constant operational temperature in the fixing device, the temperature controller upon startup directs the heater to initially warm the fixing member up to a target temperature sufficient for fixing, and retain the heat in the fixing member until a recoding medium enters the fixing device.

Two important requirements of temperature control in such a thermal fixing device are the ability to rapidly raise the temperature of a fixing member to a desired target temperature, and the ability to prevent the temperature of the fixing member from overshooting the target temperature once that target temperature has been reached. The rapid heating requirement arises since an electrophotographic printer cannot operate unless the fixing device is sufficiently warm, in which taking much time to warm up the fixing member results in a longer period of time during which a user must wait for a print job to be executed. On the other hand, the overshoot prevention requirement should be met since overheating the fixing member leads to image defects due to fusing toner at excessively high temperatures, such as lack of gloss on printed images, or undesirable transfer of melted toner to recording media (often referred to as "hot offset").

As can be readily appreciated, these requirements are mutually contradictory, however. That is, increasing power supply to the heater to accelerate the heating results in a greater amount of overshoot in the fixing temperature, and reducing power supply to the heater to prevent overshoot results in longer periods of time required to heat the fixing member to the target temperature.

To satisfy both of the above requirements, various methods have been developed to offer an efficient temperature controller for a fixing device, some of which employ on-off control and PID (control composed of proportional (P), integral (I), and derivative (D) actions), the two basic algorithms often used to control temperature in a thermal process.

Specifically, an ordinary on-off temperature controller works by turning on or off power supply to a heater depending on whether a process temperature is below or above a set-point temperature. When used in a fixing device, the on-off controller allows for an extremely short warm-up time, supplying the heater with full power as long as the fixing temperature remains below a desired operational temperature. However, such control fails to prevent an overshoot of the fixing temperature because the heater power turns off only after the fixing temperature exceeds the operational temperature.

By contrast, a PID controller controls a process temperature by adjusting power supply to a heater as a proportion of time during which the heater is active (referred to as "duty cycle") according to a difference between the process temperature and a set-point temperature. When used in a fixing device, the PID controller maintains the heater power relatively high when the fixing temperature is farther below the set-point temperature, and decreases the heater power as the fixing temperature approaches the set-point temperature. Such control effectively reduces the amount of overshoot in the fixing temperature, but simultaneously results in an increased warm-up time compared to that required for warm-up with an on-off controller.

Hence, on-off control and PID control each has both advantages and drawbacks. A comparison between the two control techniques is shown in FIG. 1, which is a graph plotting a temperature T of a fixing member and a duty cycle D of a heater in a fixing device, both against time. The measurements of FIG. 1 are obtained with an on-off controller ("$T_{on\text{-}off}$" and "$D_{on\text{-}off}$") and a PID controller ("$T_{pid}$" and "$D_{pid}$") controlling the heater to warm the fixing device to an operational set-point To.

As shown in FIG. 1, the operational temperature To is reached more rapidly with the on-off controller than with the PID controller, while the amount of overshoot is smaller with the PID controller than with the on-off controller.

Several conventional methods propose a temperature controller that can operate in either an on-off mode or a PID mode to combine the advantages of the two types of temperature control. Such a dual-mode temperature controller switches the control mode when a process temperature monitored by a sensor exceeds a switching threshold temperature.

For example, one conventional temperature control method for a fixing device controls operation of a heater using a combination of an on-off mode and an integral (I) control mode, which activates the heater continuously in the on-off mode as long as the monitored temperature remains below a switching threshold lower than an operational set-point, and enters the I-control mode to execute an integral control action when the process temperature exceeds the threshold temperature.

Other similar methods include a temperature control circuit that executes a PID control action when the process temperature exceeds the threshold temperature, as well as a temperature control method and apparatus that executes a proportional (P) control action when the switching threshold is exceeded.

Further, a sophisticated form of such dual-mode temperature control uses a combination of an on-off mode and a PID mode with multiple temperature thresholds. In addition to being capable of switching between the off mode and the PID mode at a switching threshold, this temperature controller can modify a tuning parameter of a PID algorithm when the process temperature exceeds each of the multiple temperature thresholds. Such a control method overcomes limitations of the preceding temperature controllers that only switch control mode at a single threshold temperature, and therefore can be insufficient where precision is needed to meet both rapid heating and overshoot reduction requirements in a thermal fixing device.

Owing to the combined advantages of on-off control and PID control, the dual-mode temperature controllers effectively provide both rapid heating and overshoot reduction where the fixing temperature continuously increases from a lower level (e.g., during initial warm-up). However, such a strategy does not work well in certain situations where the fixing temperature fluctuates toward a set-point rather than continuously increasing thereto. The following describes a detrimental situation for a conventional dual-mode temperature controller of a thermal fixing device.

FIG. 2 schematically illustrates a fixing device 120 used in a typical image forming apparatus.

As shown in FIG. 2, the fixing device 120 includes an endless fixing belt 124 running around a fixing roller 122 and a heat roller 123, with a pressure roller 121 pressed against the fixing belt 124 to form a fixing nip therebetween. The fixing device 120 also includes first and second heaters 130 and 131 inside the heat roller 123 and the pressure roller 131, respectively, as well as a temperature sensor 125 monitoring a temperature of the fixing belt 124 adjacent to the heat roller 123.

During operation, the heaters 130 and 131 heat the fixing belt 124 according to a belt temperature T sensed by the temperature sensor 125 so as to maintain the temperature T at desired levels. When the image forming apparatus receives a print request, the fixing belt 124 rotates in sync with the pressure roller 121 to pass a recording sheet through the fixing nip so as to apply heat and pressure to the incoming recording sheet.

FIG. 3 provides a graph showing the belt temperature T monitored by the temperature sensor 125 in the fixing device 120 plotted against time in seconds (s), together with the operating status of the fixing belt 124 since startup of the image forming apparatus.

As shown in FIG. 3, during an initial warm-up phase Pw, the fixing belt 124 rotates with the pressure roller 121 while heating up to a standby temperature Ts sufficient for fixing with the heaters 130 and 131 activated. When no print request is received upon completion of the warm-up phase Pw, the fixing device 120 enters a standby phase Ps in which the fixing belt 124 and the roller 121 stop rotation while the heaters 130 and 131 remain active to maintain the belt temperature T at the constant level Ts, holding it ready for rapid recovery.

When receiving a print request during the standby phase Ps, the fixing device enters a recovery phase Pr in which the fixing belt 124 and the roller 121 resume rotation so that the heaters 130 and 131 uniformly heat the entire length of the rotating fixing belt 124 to an operational temperature To sufficient for fixing, which is in this case slightly lower than the standby temperature Ts. When the operational temperature To is reached, the fixing device 120 enters a fixing phase Pf to fuse a toner image onto an incoming recording sheet. After fixing, the fixing device 120 again enters the standby phase Ps by stopping rotation of the fixing belt 124 and the roller 121.

FIG. 4 illustrates in detail the belt temperature T monitored from the standby phase Ps to the fixing phase Pf.

As shown in FIG. 4, the belt temperature T sharply declines from the standby temperature Ts upon switching from the standby phase Ps to the recovery phase Pr, and thereafter fluctuates between higher and lower levels while gradually approaching the set-point temperature To. Such fluctuation of the monitored temperature T arises from uneven distribution of heat over the length of the fixing belt 124. That is, the fixing belt 124 during standby has relatively hot portions retained in contact with the rollers 123 and 121 and receiving heat from the heaters 130 and 131 therethrough, and relatively cold portions not in direct contact with the heaters 130 and 131. When the unevenly heated belt 124 rotates after standby, the temperature sensor 125 senses temperatures of the (relatively) hot and cold portions alternately so that its output fluctuates between higher and lower levels during recovery. Specifically, the belt temperature T fluctuates below the operational set-point To with a certain difference between the highest and lowest levels (e.g., on the order of approximately 20 degrees), where the standby set-point Ts is set at a temperature equal to or slightly (e.g., on the order of approximately 10 degrees) lower or higher than the operational set-point To.

As mentioned, the conventional dual-mode temperature controller switches the control mode when the monitored fixing temperature reaches a threshold temperature. Such a switching threshold is set at an appropriate level depending on properties of the fixing device, such as the thermal capacities of fixing members, and the dead time required until the fixing temperature starts to rise upon activation of the heater, which typically falls within a range approximately 20 to 50 degrees lower than a desired operational temperature.

With further reference to FIG. 4, consider a case where the switching threshold is set at a temperature Tx between the highest and lowest levels of the belt temperature T during recovery. Naturally, the fluctuating temperature T reaches the switching threshold Tx more than once, and the temperature controller switches the control mode frequently whenever the threshold temperature Tx is reached. The result is the recovery phase Pr is longer than required, reducing the efficacy of the dual-mode temperature controller in rapidly heating the fixing member.

Hence, what is required is a temperature controller for a fixing device which provides both rapid heating and reliable overshoot prevention even when a monitored fixing temperature fluctuates during recovery from standby. Having such a stable temperature controller is advantageous particularly with modern fixing devices that employ thin-walled fixing rollers or fixing belts with low thermal capacities for reducing warm-up time and energy consumption, which are ready to warm up and to cool down, and therefore are susceptible to temperature variations.

SUMMARY OF THE INVENTION

Exemplary aspects of the present invention are put forward in view of the above-described circumstances, and provide a novel image forming apparatus incorporating a thermal fixing device that fixes toner images onto recording media with a heated fixing member.

Other exemplary aspects of the present invention provide a novel temperature control method for use in an image forming apparatus incorporating a thermal fixing device that fixes toner images onto recording media with a heated fixing member.

In one exemplary embodiment, the novel image forming apparatus includes an imaging section and a thermal fixing device. The imaging section forms an image with toner on a recording sheet. The thermal fixing device fuses the toner image onto the recording sheet passing through a fixing nip. The fixing device includes a fixing member, a pressure member, a heater, a temperature sensor, and a temperature controller. The fixing member is rotatable to convey the recording sheet during fixing. The pressure member is pressed against the fixing member to form the fixing nip therebetween. The heater heats at least a portion of the fixing member. The temperature sensor senses a temperature of the fixing member. The temperature controller controls the temperature of the fixing member in at least one of an on-off mode and a PID mode. The heater only locally heats the fixing member during standby where the fixing member stops rotation, and uniformly heats the rotating fixing member to an operational temperature during recovery where the fixing member resumes rotation in preparation for fixing. The temperature controller initially operates in the on-off mode upon entering recovery, and subsequently switches to the PID mode at a threshold time elapsing after entering recovery.

In another exemplary embodiment, the novel image forming apparatus includes an imaging section and a thermal fixing device. The imaging section forms an image with toner on a recording sheet. The thermal fixing device fuses the toner image onto the recording sheet passing through a fixing nip. The fixing device includes a fixing member, a pressure member, a heater, a temperature sensor, and a temperature controller. The fixing member is rotatable to convey the recording sheet during fixing. The pressure member is pressed against the fixing member to form the fixing nip therebetween. The heater heats at least a portion of the fixing member. The temperature sensor senses a temperature of the fixing member. The temperature controller controls the temperature of the fixing member in at least one of an on-off mode and a PI-D mode. The heater only locally heats the fixing member during standby where the fixing member stops rotation, and uniformly heats the rotating fixing member to an operational temperature during recovery where the fixing member resumes rotation in preparation for fixing. The temperature controller initially operates in the on-off mode upon entering recovery, and subsequently switches to the PI-D mode at a threshold time elapsing after entering recovery.

In still another exemplary embodiment, the novel temperature control method includes steps of rotation stopping, local heating, rotation resumption, uniform heating, and mode switching. The thermal fixing device fuses a toner image onto a recording sheet passing through a fixing nip, and includes a fixing member, a pressure member, a heater, a temperature sensor, and a temperature controller. The fixing member is rotatable to convey the recording sheet during fixing. The pressure member is pressed against the fixing member to form the fixing nip therebetween. The heater heats at least a portion of the fixing member. The temperature sensor senses a temperature of the fixing member. The temperature controller controls the temperature of the fixing member in at least one of an on-off mode and a PI-D mode. The rotation stopping step stops rotation of the fixing member upon entering standby. The local heating step heats the fixing member at rest only locally during standby. The rotation resumption step resumes rotation of the fixing member upon entering recovery in preparation for fixing. The uniform heating step heats the rotating fixing member uniformly to an operational temperature during recovery. The mode switching step switches the temperature controller from the on-off mode to the PID mode at a threshold time elapsing after entering recovery.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
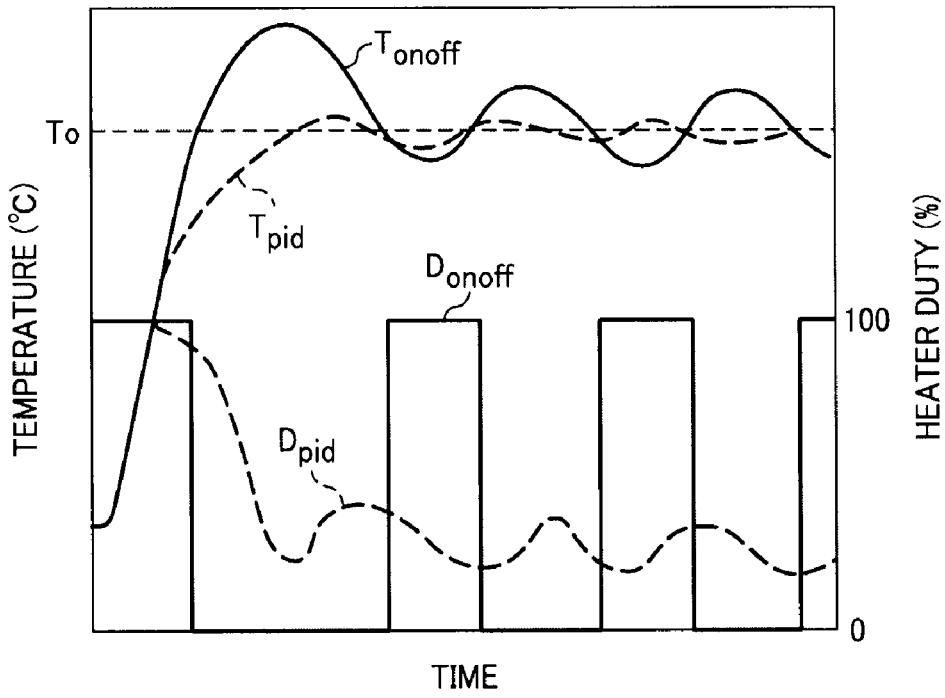
FIG. 1 BACKGROUND ART
FIG. 1 is a graph plotting a temperature of a fixing member and a duty cycle of a heater in a fixing device, both against time.
Figure 2:
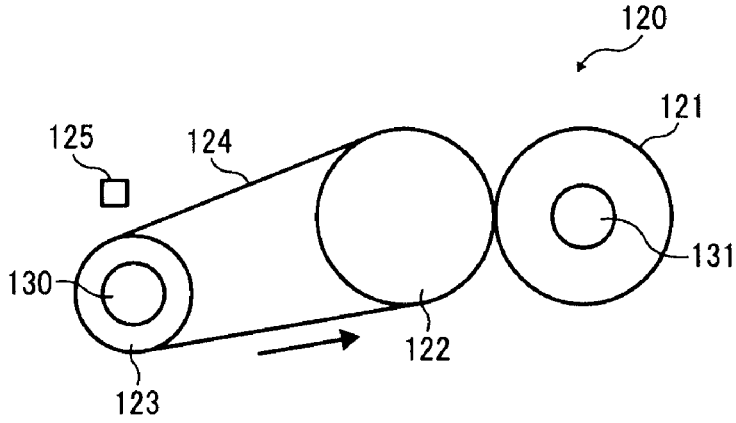
FIG. 2 BACKGROUND ART
FIG. 2 schematically illustrates a fixing device used in a typical image forming apparatus.
Figure 3:
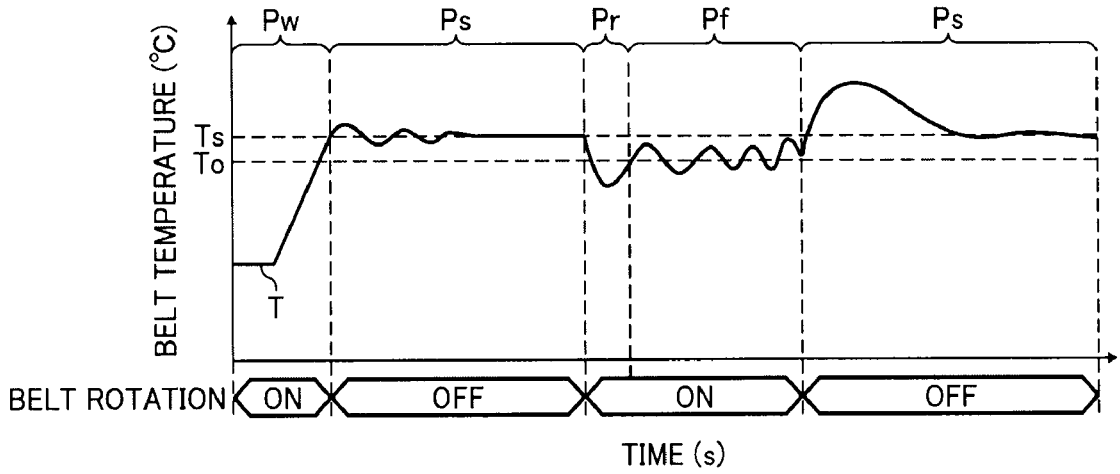
FIG. 3 BACKGROUND ART
FIG. 3 is a graph showing a temperature of a fixing belt monitored by a temperature sensor in the fixing device plotted against time, together with the operating status of the fixing belt since startup of the image forming apparatus of FIG. 2.
Figure 4:
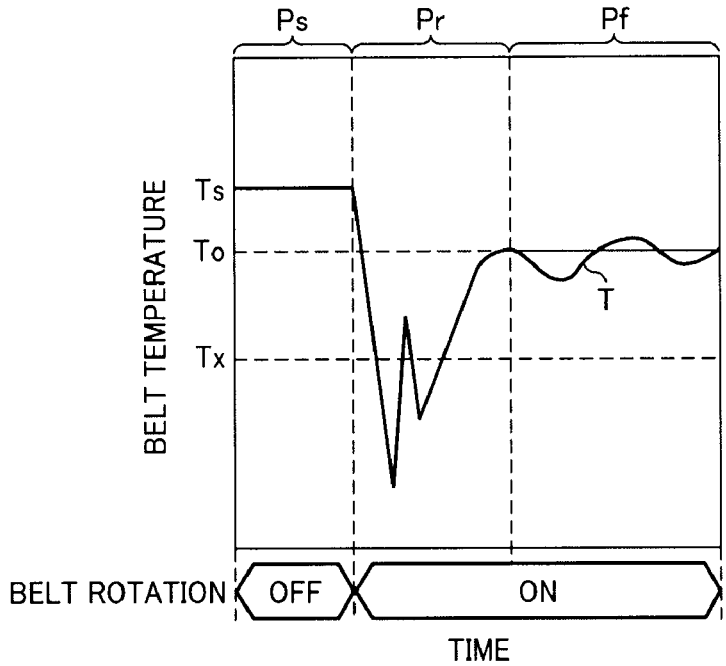
FIG. 4 BACKGROUND ART
FIG. 4 illustrates in detail the belt temperature of FIG. 3.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, exemplary embodiments of the present patent application are described.

Figure 5:
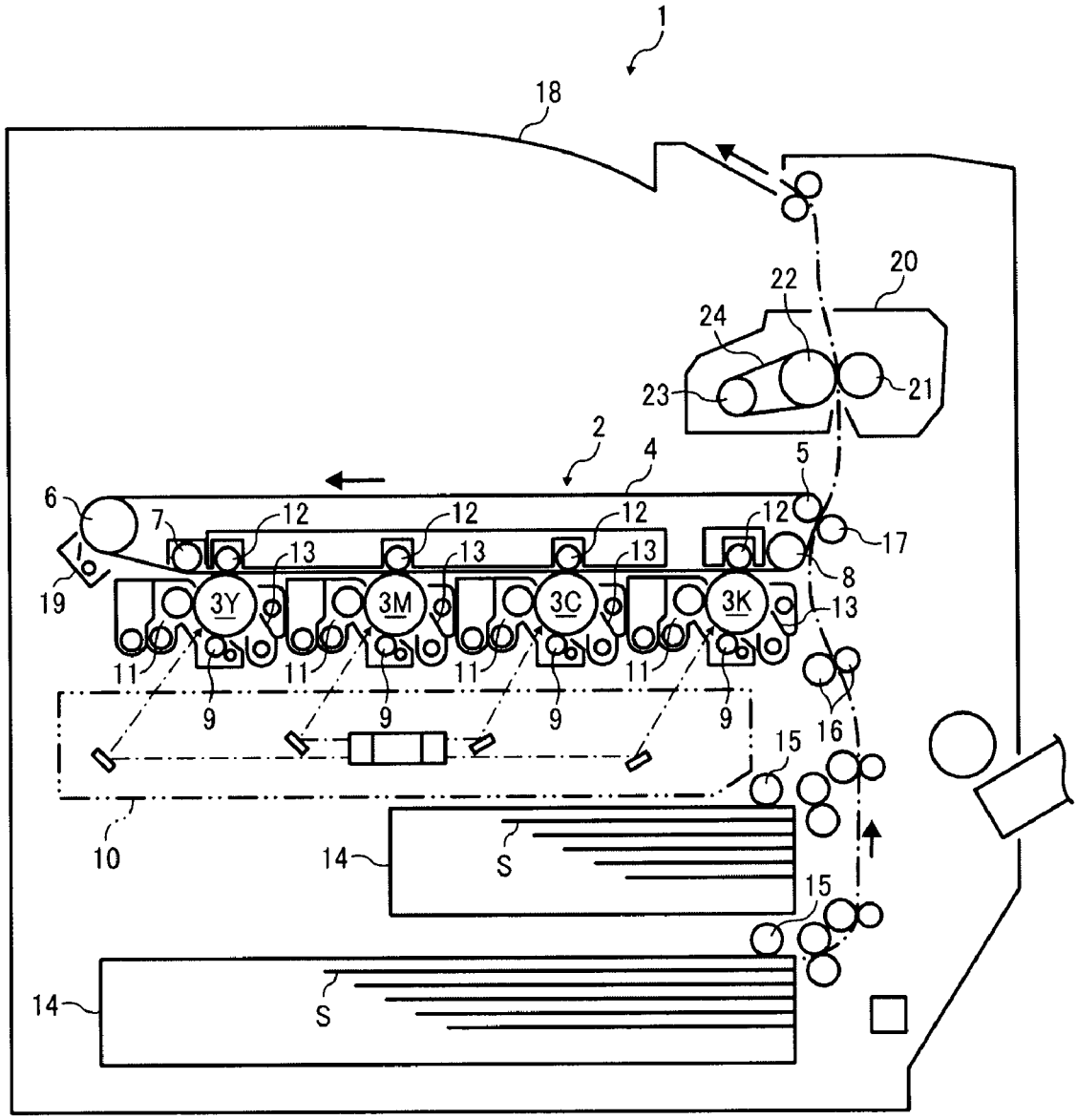
FIG. 5 is a cross-sectional view schematically illustrating an image forming apparatus according to this patent specification.

FIG. 5 is a cross-sectional view schematically illustrating an image forming apparatus 1 according to this patent specification.

As shown in FIG. 5, the image forming apparatus 1 includes an imaging section 2 and a thermal fixing device 20 as well as a sheet feeding mechanism including multiple feed rollers.

In the image forming apparatus 1, the imaging section 2 includes a series of drum-shaped photoconductors 3Y, 3M, 3C, and 3K to form images with four primary colors, yellow, magenta, cyan, and black, respectively, each having a photoconductive surface surrounded with a charging roller 9, a development device 11, a primary transfer roller 12, and a cleaning device 13. Below the series of photoconductors 3 lies an exposure device 10 to irradiate each photoconductive surface with a laser beam modulated according to image data.

The imaging section 2 also includes an intermediate transfer belt 4 trained around four support rollers 5 through 8 to rotate in the direction of arrow through primary transfer nips defined between the photoconductive drums 3 and the primary transfer rollers 12, with a belt cleaner 19 cleaning the belt surface upstream of the primary transfer nips.

The fixing device 20 includes a fixing roller 22, a heat roller 23, an endless fixing belt 24 trained around the rollers 22 and 23, and a pressure roller 21 pressed against the fixing belt 24 to form a fixing nip therebetween, as well as thermal equipment as will be described later in more detail. Although the present embodiment uses the two belt support rollers 22 and 23, the fixing belt may run around any number of rollers where appropriate.

The sheet feeding mechanism includes a sheet cassette 14 accommodating recording sheets S, a sheet feed roller 15, a pair of registration rollers 16, a secondary transfer roller 17, and an output tray 18. The sheet feeding mechanism defines a sheet feed path along which a recording sheet S travels upward from a sheet feed cassette 14 to an output tray 18 through a transfer nip defined by the intermediate transfer belt 4 and the opposing rollers 5 and 17, as well as the fixing nip inside the fixing device 20.

During operation, the image forming apparatus 1 can perform printing in various print modes, including a monochrome print mode and a full-color print mode, as specified by a print job received from a user.

In full-color printing, the imaging section 2 rotates each photoconductive drum 3 clockwise in the drawing to forward the photoconductive surface first to the charging roller 9 charging the photoconductive surface to a given polarity, then to the laser beam emitted from the exposure unit 10 to form an electrostatic latent image thereon, followed by the development device 11 developing the latent image into a visible image with toner.

The photoconductive surface then advances to the primary transfer nip in which the primary transfer roller 12, electrically biased with a given transfer voltage, transfers the developed toner image to the intermediate transfer belt 4. After transfer, the photoconductive surface is cleaned of residual toner with the cleaning device 13 in preparation for a subsequent imaging cycle.

The imaging section 2 repeats such a process to generate yellow, magenta, cyan, and black toner images on the photoconductive drums 3Y, 3M, 3C, and 3K, respectively, which are successively transferred to the surface of the intermediate transfer belt 2. This results in the four toner images superimposed one atop another to form a full-color toner image on the intermediate transfer belt 2.

During the imaging processes, the sheet feeding mechanism rotates the feed roller 15 to feed a recoding sheet S from the sheet feed cassette 14 to the sheet feed path. In the sheet feed path, the registration rollers 16 forward the fed sheet S into the secondary transfer nip in sync with the intermediate transfer belt 4 forwarding the toner image, in which the secondary transfer roller 17, electrically biased with a given transfer voltage, transfers the full-color toner image to the incoming sheet S from the belt surface.

After secondary transfer, the intermediate transfer belt 4 is cleaned of residual toner with the belt cleaner 19, and the recording sheet S enters the fixing device 20. The fixing device 20 fixes the toner image in place by applying heat and pressure to the recording sheet S passing through the fixing nip. Thereafter, the recording sheet S advances to the output tray 18 for user pickup.

Figure 6:
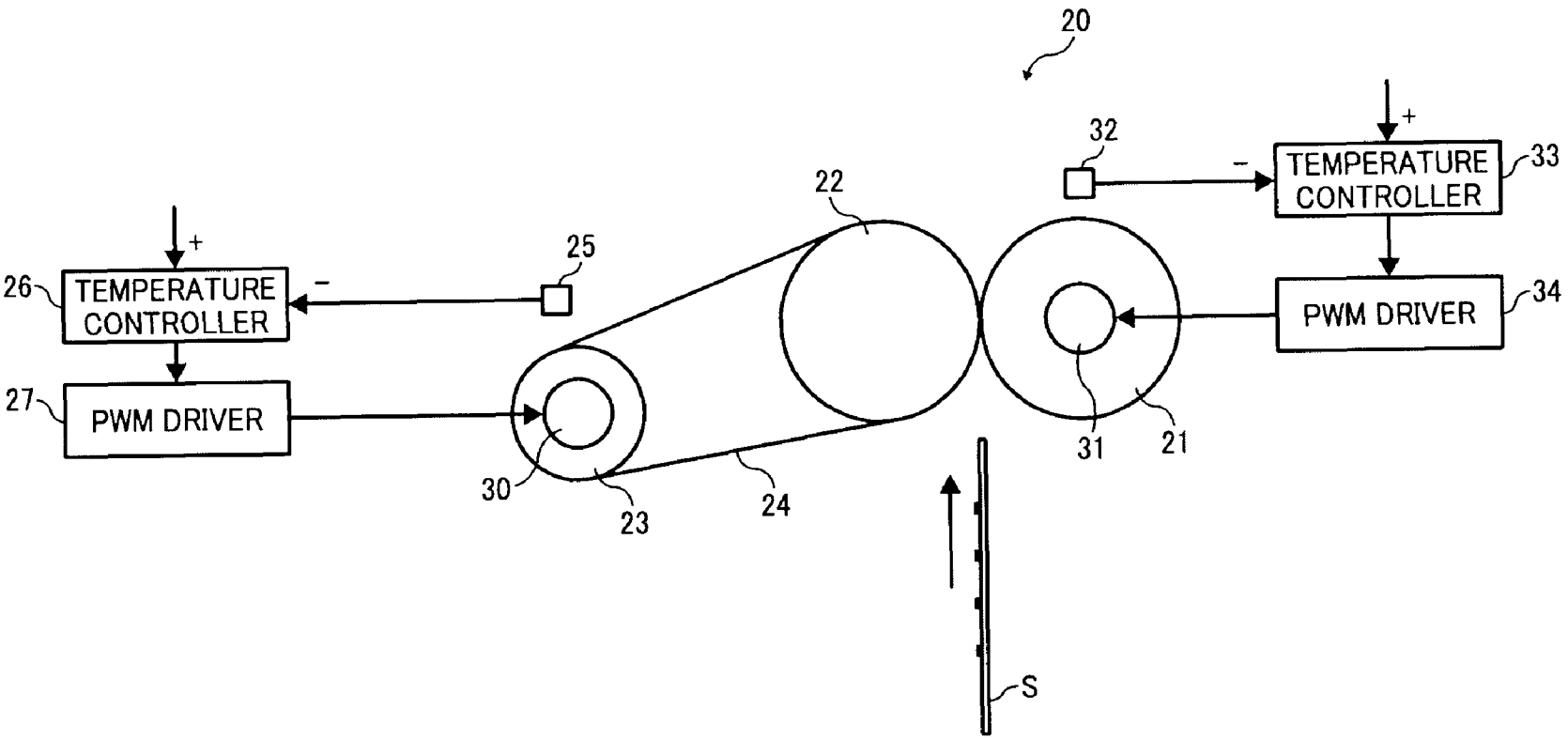
FIG. 6 schematically illustrates a fixing device incorporated in the image forming apparatus 1.

FIG. 6 schematically illustrates the fixing device 20 incorporated in the image forming apparatus 1.

As shown in FIG. 6, the fixing device 20 includes first and second thermometers or temperature sensors 25 and 32, and first and second heaters 30 and 31 in addition to the pressure roller 21, the fixing roller 22, the heat roller 23, the fixing belt 24.

In the fixing device 20, the first and second heaters 30 and 31 are located inside the heat roller 23 and the pressure roller 21, respectively. Such heaters 30 and 31 may include not only heat irradiators, such as halogen heaters and carbon heaters, but also induction heaters that heat an object by electromagnetic induction.

The first thermometer 25 faces the surface of the fixing belt 24 adjacent to the heat roller 23, and the second thermometer 32 faces the surface of the pressure roller 21. The first thermometer 25 is in communication with a first temperature controller 26 controlling the first heater 30 through a first pulse width modulation (PWM) driver 27. Similarly, the second thermometer 32 is in communication with a second temperature controller 33 controlling the second heater 31 through a second PWM driver 34.

During operation, the first thermometer 25 monitors temperature of the fixing belt 24 for communication to the first temperature controller 26, and the second thermometer 32 monitors temperature of the pressure roller 21 for communication to the second temperature controller 33.

The temperature controller 26 compares the monitored belt temperature against a given target temperature of the fixing belt 24, and directs the PWM driver 27 to accordingly adjust power supply to the belt heater 30. Similarly, the second temperature controller 33 compares the monitored roller temperature against a given target temperature of the pressure roller 31, and directs the PWM driver 34 to accordingly adjust power supply to the roller heater 31. The PWM drivers 27 and 34 controls operation of the heaters 30 and 31 by regulating a duty cycle D representing the proportion of time during which the heater is active in a given period of time.

In such a configuration, the fixing device 20 controls a temperature T of the fixing belt 24 at desired levels in coordination with the operation of the fixing belt 24 and the pressure roller 24 through several operational phases, including a warm-up phase Pw, a standby phase Ps, a recovery phase Pr, and a fixing phase Pf. Specifically, the warm-up phase Pw starts upon startup of the image forming apparatus 1, and terminates when the fixing belt 24 warms up to a standby temperature Ts sufficient for fixing. The standby phase Ps starts when the fixing belt 24 stops rotation (e.g., upon completion of the warm-up phase Pw), and terminates when the fixing belt 24 resumes rotation in response to a print request submitted. The recovery phase Pr starts upon termination of the standby phase Ps, and terminates when the fixing belt 24 uniformly warms up to a recovery temperature Tr sufficient for fixing, which may be equal to or approximately 5° C. less than a desired operational temperature To. The fixing phase Pf starts when a recording sheet S for the first page of a print job enters the fixing nip, and terminates when a recording sheet S for the last page of the print job leaves the fixing nip.

Figure 7:
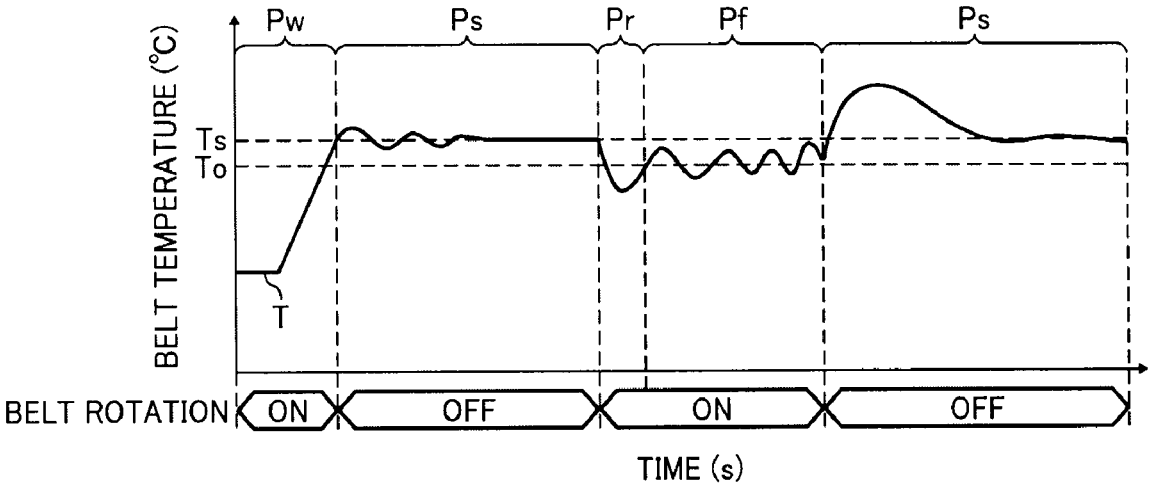
FIG. 7 is a graph showing a temperature of a fixing belt monitored by a temperature sensor in the fixing device of FIG. 6 plotted against time, together with the operating status of the fixing belt since startup of the image forming apparatus.

FIG. 7 is a graph showing the belt temperature T monitored in the fixing device 120 plotted against time in seconds (s), together with the operating status of the fixing belt 24 since startup of the image forming apparatus 1.

As shown in FIG. 7, during the initial warm-up phase Pw, the fixing belt 24 rotates with the pressure roller 21 while heating up to the standby temperature Ts with the heaters 30 and 31 activated. When no print request is received upon completion of the warm-up phase Pw, the fixing device 20 enters the standby phase Ps in which the fixing belt 24 and the pressure roller 21 stop rotation while the heaters 30 and 31 remain active to maintain the belt temperature T at the constant level Ts, holding it ready for rapid recovery.

When receiving a print request during the standby phase Ps, the fixing device 20 enters the recovery phase Pr in which the fixing belt 24 and the pressure roller 21 resume rotation so that the heaters 30 and 31 uniformly heat the entire length of the rotating fixing belt 24 to the operational temperature To, which is in this case slightly lower than the standby temperature Ts. When the operational temperature To is reached to complete the recovery phase Pr, the fixing device 20 enters the fixing phase Pf in which one or more recording sheets S pass through the fixing nip to fuse toner images for the requested print job. Upon detecting a final recording sheet exiting the fixing nip, e.g., by a photointerruptor, the fixing device 20 again enters the standby phase Ps by stopping rotation of the fixing belt 24 and the pressure roller 21.

Alternatively, the completion of the recovery phase Pr and the start of the operational phase Pf may overlap each other so as to shorten the period of time required between receipt of a print request and fixing, in which case the first recording sheet S for a particular print job advances toward the fixing nip before the belt temperature T reaches the operational temperature To at the end of the recovery phase Pr.

Thus, the fixing device 20 controls the belt temperature T according to the different phases so as to maintain the constant operational temperature To throughout the fixing process. In particular, having the recovery phase Pr subsequent to the standby phase Ps ensures that the belt temperature T is sufficiently high at the start of the fixing phase Pf to prevent print failures due to insufficient fusing of toner at the fixing nip.

Figure 8:
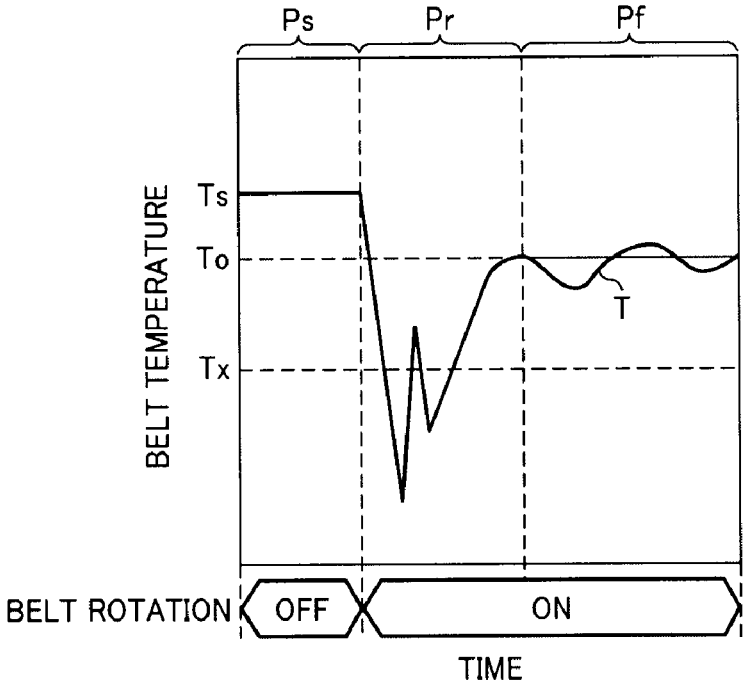
FIG. 8 illustrates in detail the belt temperature of FIG. 7.

FIG. 8 illustrates in detail the belt temperature T monitored from the standby phase Ps to the fixing phase Pf.

As shown in FIG. 8, the belt temperature T sharply declines from the standby temperature Ts upon switching from the standby phase Ps to the recovery phase Pr, and thereafter fluctuates between higher and lower levels while gradually approaching the set-point temperature To. Such fluctuation of the monitored temperature T arises from uneven distribution of heat over the length of the fixing belt 124. That is, the fixing belt 24 during standby has relatively hot portions retained in contact with the rollers 23 and 21 and receiving heat from the heaters 30 and 31 therethrough, and relatively cold portions remaining apart from the heaters 30 and 31. When the unevenly heated belt 24 rotates after standby, the temperature sensor 25 senses temperatures of the (relatively) hot and cold portions alternately so that its output fluctuates between higher and lower levels during recovery.

According to this patent specification, at any given point in time the temperature controller 26 operates in one of an on-off mode and a proportional-integral-differential (PID) control mode. In particular, the temperature controller 26 uses a combination of the on-off mode and the PID mode during the recovery phase Pr in which the monitored belt temperature T fluctuates toward the desired set-point To.

Specifically, in the on-off mode, the temperature controller 26 turns power supply to the heater 30 completely off when the monitored belt temperature T exceeds a set-point temperature, and completely on when the monitored belt temperature T remains below the set-point temperature.

In the PID mode, the temperature controller 26 regulates power supply to the heater 30 using a PID algorithm composed of proportional, integral, and derivative terms to constantly adjust the duty cycle D based on a difference between the monitored temperature T and a desired set-point. Compared to the binary on-off mode, the PID mode allows for precise temperature control particularly where the belt temperature T is close to the set-point temperature.

More specifically, the PID algorithm used in the temperature controller 26 calculates a dependent variable by tuning the multiple parameters according to a difference between a desired set-point r(t) and a measured process value y(t) as follows:

$$u = K_p\left(e(t) + \frac{1}{T_I}\int_0^t e(\tau)\,d\tau + T_D\frac{de(t)}{dt}\right) \qquad \text{Eq. 1}$$

where u(t) is a dependent variable, $K_p$ is a proportional gain, $T_I$ is an integral time, $T_D$ is a derivative time, and e(t) is an error or difference between r(t) and y(t).

The temperature controller 26 determines the duty cycle D of the heater according to a difference between a desired set-point temperature r(t) and a measured belt temperature y(t). For application to the temperature controller 26, the basic equation Eq. 1 is rewritten by replacing u(t) with DUTY representing the duty cycle D:

$$\text{DUTY} = K_p\left(e(t) + \frac{1}{T_I}\int_0^t e(\tau)\,d\tau + T_D\frac{de(t)}{dt}\right) \qquad \text{Eq. 2}$$

Further, the analog PID algorithm thus obtained is transformed into a digital form with a sampling period T through staircase approximation:

$$\text{DUTY} = K_p\left(e(k) + \frac{1}{T_I}\sum_{j=-\infty}^{k} e(j)T + T_D\frac{e(k)-e(k-1)}{T}\right) \quad \text{Eq. 3}$$

Using the digital PID algorithm given by Eq. 3, the temperature controller 26 can calculate the duty cycle D based on the difference between the set-point temperature and the monitored temperature T for each sampling period T.

Alternatively, the PID algorithm Eq. 2 may be digitized through bilinear transform instead of staircase approximation as follows:

$$\text{DUTY} = K_p\left(e(k) + \frac{1}{T_I}\sum_{j=-\infty}^{k} \frac{T}{2}\{e(j-1)+e(j)\} + T_D\frac{e(k)-e(k-1)}{T}\right) \quad \text{Eq. 4}$$

Further, instead of the positional algorithm given by Eq. 3, a velocity algorithm that calculates a variation ΔDUTY in duty cycle for each sampling period T may also be used:

$$\Delta\text{DUTY} = K_p\left(e(k) - e(k-1) + \frac{T}{T_I}e(k) + \frac{T_D}{T}\{e(k) - 2e(k-1) + e(k-2)\}\right) \quad \text{Eq. 5}$$

Moreover, the temperature controller 26 can control operation of the heater 30 by combining on-off control with variants of PID control, such as PI-D control, I-PD control, or the like. Using a suitable control algorithm in place of the basic PID algorithms described above allows for good stability of the temperature controller 26 in the PID mode.

For example, the temperature controller 26 in the PID mode may use a PI-D control algorithm given by the following equation:

$$\Delta\text{DUTY} = K_p\left(e(k) - e(k-1) + \frac{T}{T_I}e(k) - \frac{T_D}{T}\{y(k) - 2y(k-1) + y(k-2)\}\right) \quad \text{Eq. 6}$$

The PI-D control algorithm of Eq. 6 is obtained through modification of a PID algorithm, which eliminates a derivative action that tends to induce a "kick" or sudden change in the dependent variable in response to a change in the set-point (e.g., switching a set-point temperature from 150° to 170° C. can cause a sudden change in the duty cycle of a PID-controlled heater). The kick phenomenon arises from the nature of a PID controller designed to rapidly respond to a sudden change in the controlled process. However, a kick can cause harmful mechanical and/or physical effects on the controller as well as on the controlled process or system, which can be considerable depending on applications. Thus, using the PI-D algorithm instead of the PID algorithm in the PID mode allows for more stable performance of the temperature controller 26 as well as the fixing device 20.

Alternatively, the temperature controller 26 in the PID mode may use a I-PD control algorithm given by the following equation:

$$\Delta\text{DUTY} = K_p\left(\frac{T}{T_I}e(k) - \{e(k) - e(k-1)\} - \frac{T_D}{T}\{y(k) - 2y(k-1) + y(k-2)\}\right) \quad \text{Eq. 7}$$

The IP-D control algorithm of Eq. 7 is obtained by eliminating proportional and derivative actions that tend to produce a relatively large kick compared to that originating from a proportional action. As in the case with the PI-D algorithm, using the IP-D algorithm in the PID mode may further stabilize the operation of the temperature controller 26 as well as the fixing device 20.

Figure 9:
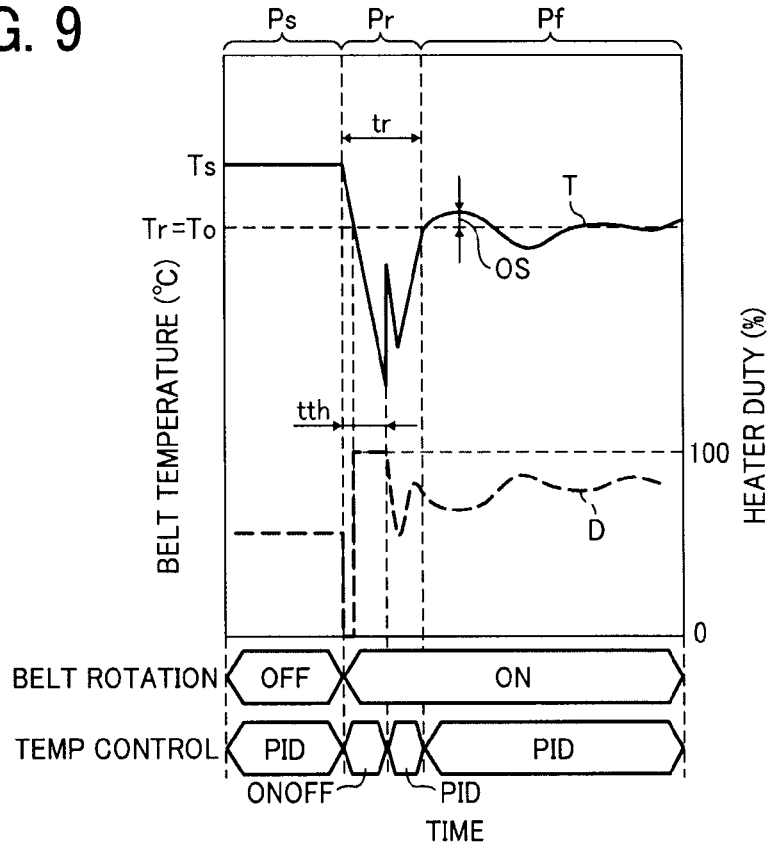
FIG. 9 is a graph showing the temperature of the fixing belt and a duty cycle of a heater in the fixing device of FIG. 6 both plotted against time, together with timing charts showing operating status of the fixing belt and a temperature controller.

FIG. 9 is a graph showing the belt temperature T and the duty cycle D in the fixing device 20 both plotted against time, together with timing charts showing the operating status of the fixing belt 24 and the temperature controller 26 from the standby phase Ps to the fixing phase Pf.

As shown in FIG. 9, the belt temperature T fluctuates between higher and lower levels corresponding to the portions of the fixing belt 24 heated and unheated during the standby phase Ps, and the operational temperature To lies between the minimum and maximum levels of the fluctuating temperature T.

The temperature controller 26 operates in the PID mode during the phases Ps and Pf prior to and the subsequent to the recovery phase Pr. By contrast, during the recovery phase Pr, the temperature controller 26 initially operates in the on-off mode and then switches to the PID mode when a given period of threshold time tth has elapsed after entering the recovery phase Pr.

As will be described later in more detail, the switching threshold time tth is determined according to specific conditions under which the fixing device 20 is operated. Such determination is based on a lookup table or function obtained through experimentation and/or simulation, which provides an optimal switching threshold time tth that can reduce the amount of overshoot OS to below a maximum allowable limit (e.g., 5 degrees Centigrade) while maintaining the recovery time tr at reasonably low levels. Depending on specific applications, the allowable limit of overshoot may be set within a reasonable range that does not cause image defects due to fusing toner at excessively high temperatures, such as lack of gloss on printed images, or undesirable transfer of melted toner to recording sheets (often referred to as "hot offset").

In such a configuration, the temperature controller 26 according to this patent specification features a relatively short period of time tr required to raise the belt temperature T to the set-point temperature Tr during the recovery phase Pr and a relatively small amount of overshoot OS by which the belt temperature T exceeds the recovery set-point Tr upon entering the fixing phase Pf. Such short recovery time tr and small overshoot OS are derived by switching the control mode from the on-off mode to the PID mode during the recovery phase Pr.

For purposes of comparison, consider a temperature controller operating solely in an on-off mode or in a PID mode during the recovery phase Pr.

Figure 10:
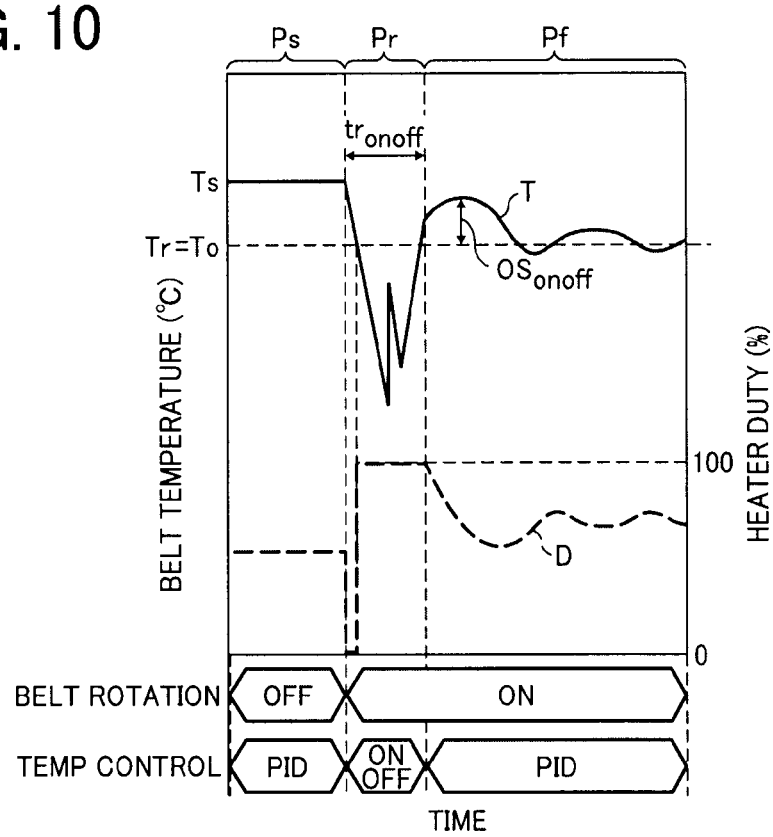
FIG. 10 is a graph showing a temperature of a fixing belt and a duty cycle of a heater in a comparative fixing device both plotted against time, together with timing charts showing operating status of the fixing belt and a temperature controller.
Figure 11:
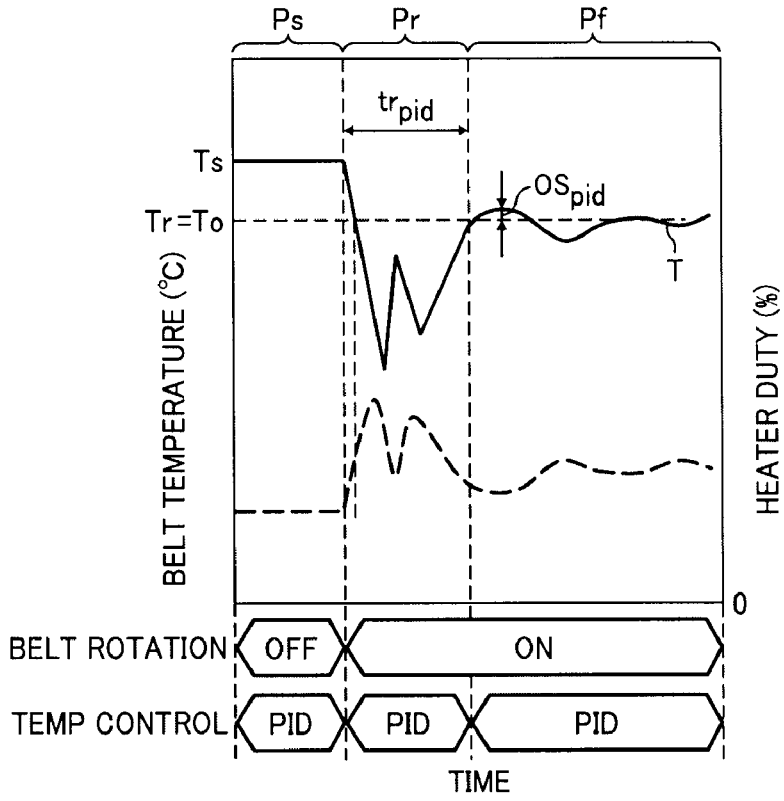
FIG. 11 is a graph showing a temperature of a fixing belt and a duty cycle of a heater in another comparative fixing device both plotted against time, together with timing charts showing operating status of the fixing belt and a temperature controller.

FIGS. 10 and 11 are graphs each showing the belt temperature T and the duty cycle D both plotted against time, together with timing charts showing the operating status of a fixing belt and a temperature controller, one in a fixing device controlling temperature only in an on-off mode during recovery (FIG. 10), and the other in a fixing device controlling temperature only in a PID mode during recovery (FIG. 11).

As shown in FIG. 10, when the belt temperature T is controlled in the on-off mode throughout the recovery phase Pr, the duty cycle D is 0% with the belt temperature T remaining above the recovery set-point Tr immediately after start of the recovery phase Pr, then switches to 100% in response to the temperature T sharply declining below the set-point temperature Tr. Such control allows for a relatively short recovery time $tr_{on\text{-}off}$, but involves a relatively large overshoot $OS_{on\text{-}off}$ that can lead to image defects, such as lack of gloss on printed images, or hot offset of melted toner.

On the other hand, when the belt temperature T is controlled in the PID mode throughout the recovery phase Pr as shown in FIG. 11, the duty cycle D varies with time as the monitored temperature T fluctuates. Such control effects an overshoot $OS_{pid}$ smaller than the overshoot $OS_{on\text{-}off}$ resulting from recovery in the on-off mode, but requires a relatively long recovery time $tr_{pid}$ leading to a longer period of time that a user must wait for a print job to be executed.

In contrast to such single-mode temperature control, the special dual-mode temperature controller 26 switchable from the on-off mode to the PID mode during recovery enables rapid heating of the fixing belt 24 during recovery as well as overshoot prevention at the start of fixing. Thus, with reference to FIG. 9, it can be seen that the temperature controller 26 has the recovery time tr comparable to the short recovery time $tr_{on\text{-}off}$ for the case of FIG. 10, and the overshoot OS comparable to the small overshoot $OS_{pid}$ for the case of FIG. 11.

Moreover, because the temperature controller 26 according to this patent specification operates according to elapsed time instead of threshold temperature, it can overcome problems encountered by a typical dual-mode temperature controller that switches between the on-off and PID modes when the belt temperature reaches a threshold temperature, as is described in detail below.

Figure 12:
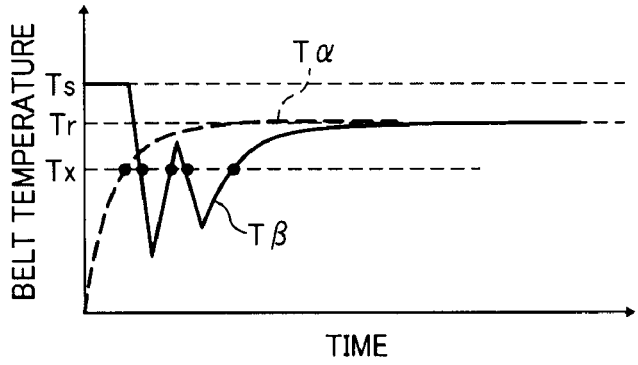
FIG. 12 is a graph showing measurements of the fixing belt temperature in the fixing device of FIG. 6 plotted against time, one set of measurements obtained during warm-up and the other obtained during recovery.

FIG. 12 is a graph showing measurements of the fixing belt temperature T plotted against time, one obtained during warm-up ("Tα" drawn in dotted line), and the other obtained during recovery ("Tβ" drawn in solid line).

As shown in FIG. 12, the belt temperature Tα during warm-up continuously increases to the recovery set-point Tr from a low level, while the belt temperature Tβ during recovery fluctuates over a range from −5° C. to −30° C. below the recovery set-point Tr as the sensor 25 senses temperatures of the heated and unheated portions of the fixing belt 24.

Although the temperature controller 26 during recovery switches the control mode at the switching threshold time tth, it can also switch from the on-off mode to the PID mode during warm-up when the belt temperature Tα exceeds a threshold temperature Tx, as in a typical dual-mode temperature controller. Such a threshold temperature Tx may be set approximately 20° C. below the recovery set-point Tr, which is determined depending on a heat capacity of the fixing belt 24 as well as a dead time during which the belt temperature T remains unchanged since activation of the heater.

Note that the belt temperature Tβ reaches the threshold temperature Tx more than once during recovery. If the temperature controller 26 switched between the on-off and PID modes whenever the threshold temperature Tx is reached during recovery, it would result in a prolonged recovery time, negating the efficacy of the dual-mode temperature control.

Accordingly, the ability to switch the control mode based on the threshold time tth rather than the threshold temperature Tx ensures the temperature controller 26 works properly when the belt temperature T fluctuates toward the operational temperature To during recovery. Such a configuration is particularly effective with the operational temperature To set between minimum and maximum temperatures of the fixing belt 24 heated at rest during standby, in which the monitored temperature T is most likely to fluctuate around the threshold temperature Tx set close to the operational temperature To.

As mentioned, the temperature controller 26 according to this patent specification determines the threshold time tth for switching the control mode according to specific conditions under which the fixing device 20 is operated, based on a lookup table or function providing values optimized through experimentation and/or simulation. The following describes embodiments in which the switching threshold time tth is optimized according to operating conditions of the fixing device 20.

In one embodiment, the temperature controller 26 determines the threshold time tth according to a standby time ts during which the fixing device 20 operates in standby mode (i.e., duration of the standby phase Ps).

This embodiment is based on the fact that the optimal threshold time tth is dependent on an amount of heat stored in the fixing device during standby. Typically, a greater amount of heat stored in a fixing device results in a shorter recovery time tr and a higher rate at which the overall belt temperature rises to the set-point Tr during recovery phase Pr. Thus, to ensure stable temperature control, the threshold time tth is modified to match the recovery time tr varying with heat storage in the fixing device.

The present embodiment estimates the amount of heat storage from the standby time ts representing the duration of standby phase Ps in which the belt heater and the roller heater heat the inside of the fixing device at rest.

Specifically, upon entering the standby phase Ps from the warm-up phase Pw, the temperature controller 26 activates a system timer that counts time elapsed since activation. When receiving a print request from a user, the temperature controller 26 enters recovery phase Pr and reads the timer count to obtain a standby time ts. The temperature controller 26 determines a threshold time tth by referring to a lookup table that associates values or ranges of standby time ts with empirically derived optimal values for threshold time tth. Table 1 below provides an example of such a lookup table.

TABLE 1

| | Standby time ts [sec.] | |
|---|---|---|
| | $0 \leqq ts < 300$ | $300 \leqq ts$ |
| Threshold time tth [sec.] | 3 | 1 |

The following describes an experimental process performed to obtain the lookup table as shown in Table 1.

The first step of the process was to specify values or ranges of values for standby time ts with which particular values of threshold time tth were to be associated.

Figure 13:
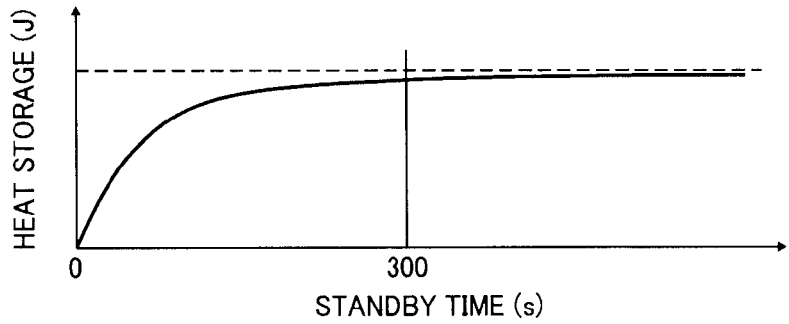
FIG. 13 is a graph showing a relation between a standby time in seconds (s) and an amount of heat in joules (J) stored in the fixing device of FIG. 6 during standby.

FIG. 13 is a graph showing a relation between the standby time ts in seconds (s) and the amount of heat in joules (J) stored in the fixing device 20 during standby. As shown, the heat storage increases as the standby time ts increases from 0 sec, and reaches a level of saturation when the standby time ts exceeds approximately 300 sec. Thus, the heat storage is relatively low with the standby time ts below 300 sec, and relatively high with the standby time ts exceeding 300 sec. Considering this data, it was determined that the threshold time tth is varied depending on whether the standby time ts falls within a first range extending from 0 to 300 sec, or a second range exceeding 300 sec.

After defining the ranges of standby time ts, the second step was to determine an optimal time threshold tth for each time range.

In this embodiment, the optimal threshold tth is defined as a value with which the temperature controller can reduce the amount of overshoot OS to below an allowable limit of 5 degrees while maintaining the recovery time tr at reasonably low levels.

Specifically, the determination involved experiments to measure amounts of overshoot OS and recovery time tr by varying switching time tth, followed by analyzing the experimental results to determine an optimal threshold tth for each range of standby time ts.

In the experiments, the fixing device was operated after standby with the temperature controller switching from the on-off mode to the PID mode at different times during recovery. The experiments were conducted with a shorter standby time of 0 sec and a longer standby time of 300 sec, assuming that the heat storage in the fixing device was minimal with the 0-sec standby time and saturated with the 300-sec standby time.

Figure 14:
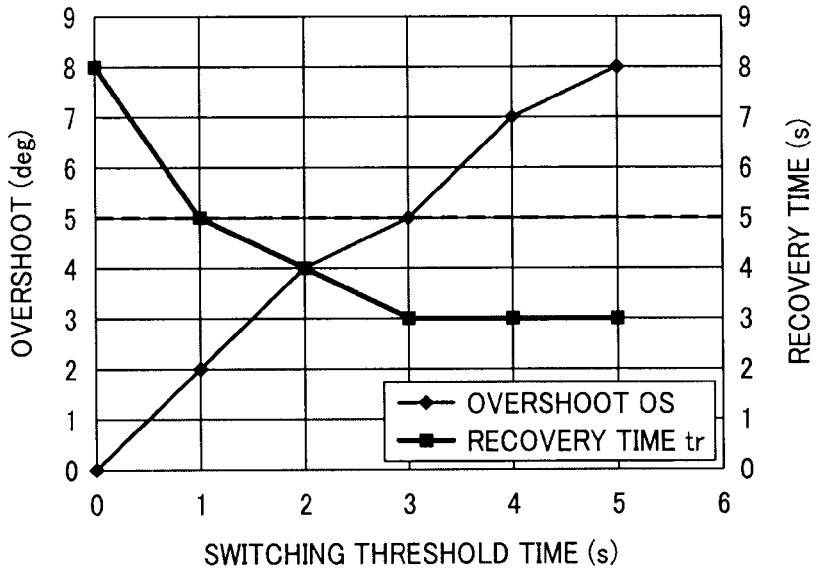
FIG. 14 is a graph showing measurements of an amount of overshoot in degrees (deg) and a recovery time in seconds (s) versus different values of threshold time in seconds (s), obtained in the fixing device of FIG. 6 with a standby time of 0 sec.
Figure 15:
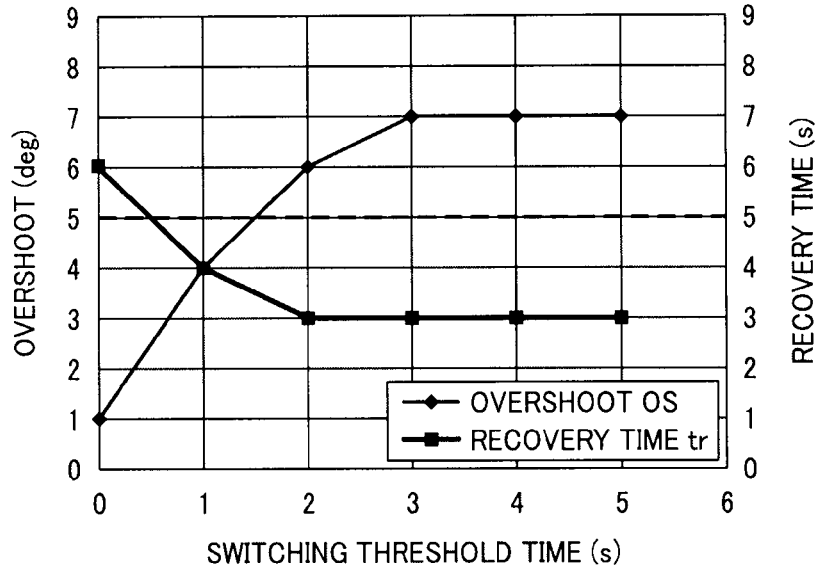
FIG. 15 is a graph showing measurements of an amount of overshoot in degrees (deg) and a recovery time in seconds (s) versus different values of threshold time in seconds (s), obtained in the fixing device of FIG. 6 with a standby time of 300 sec.

FIGS. 14 and 15 are graphs showing measurements of the overshoot OS in degrees (deg) and the recovery time tr in seconds (s) versus different values of threshold time tth in seconds (s), one obtained with the O-sec standby time (FIG. 14) and the other obtained with the 300-sec standby time (FIG. 15).

As shown in FIGS. 14 and 15, in general, the amount of recovery time tr decreases as the threshold time tth increases, and the amount of overshoot OS increases as the threshold time tth increases. With the standby time of 0 sec, the recovery time tr reaches a minimum of 3 sec when the threshold time tth exceeds 3 sec, and the overshoot OS exceeds the allowable limit of 5 degrees when the threshold time tth exceeds 3 sec. On the other hand, with the standby time of 300 sec, the recovery time tr reaches a minimum of 3 sec when the threshold time tth exceeds 2 sec, and the overshoot OS exceeds the allowable limit of 5 degrees when the threshold time tth exceeds 2 sec.

Based on the experimental results described above, the present embodiment determined an optimal threshold tth of 3 sec for the first range of standby time $0 \leqq ts < 300$, and an optimal threshold tth of 1 sec for the second range of standby time $300 \leqq ts$, thereby obtaining the lookup table as shown in Table 1. Such values reduce the amount of overshoot OS below the 5-deg maximum limit while maintaining the recovery time tr at reasonably low levels.

In making this determination, higher priority was given to limiting the overshoot OS than reducing the recovery time tr, so that the optimal threshold tth was set to 1 sec and not to 2 sec although the recovery time tr was minimized with the switching time tth exceeding 2 sec or longer.

Thus, the present embodiment can effectively optimize the threshold time tth by estimating the heat stored in the fixing device during standby based on the standby time ts.

Although the present embodiment determines the optimal threshold time tth to limit the overshoot OS within 5 degrees, it is possible to set any suitable limits on the amount of overshoot OS as well as on the length of recovery time tr.

Further, it is also possible to define a function tth=f(tr) that associates the recovery time tr with the optimal threshold time tth, in which case the switching threshold time tth is optimized by calculating the pre-defined function tth=f(tr), which may be superior in accuracy and reliability to simply referring to the lookup table.

In a further embodiment, the temperature controller 26 determines the threshold time tth according to a temperature Tpr of the pressure roller 21 measured when the fixing device starts recovery from standby.

Similar to the embodiment described above, the present embodiment is also based on the dependency of the optimal threshold time tth on the amount of heat stored in the fixing device. In particular, this embodiment estimates the amount of heat storage from the temperature Tpr of the pressure roller 21. Compared to estimating the heat storage based on the standby time ts which can be susceptible to errors due to variations in ambient temperature or other environmental factors, estimation based on the roller temperature Tpr is stable where the pressure roller 21 has a high heat capacity. Such an embodiment is readily applicable to a fixing device used in most modern printers, which typically includes a pressure roller made of high heat capacity material with a thermometer dedicated to sensing temperature of the pressure roller.

Specifically, when receiving a print request from a user, the temperature controller 26 enters the recovery phase Pr and simultaneously measures a temperature Tpr of the pressure roller 21 with the second thermometer 32. The temperature controller 26 then determines a threshold time tth by calculating a pre-defined function tth=f(Tpr) that associates the roller temperature Tpr with an empirically derived optimal value for the switching threshold time tth.

The following describes an experimental process performed to obtain the function tth=f(Tpr) used in the present embodiment.

The first step of the process was to empirically determine optimal time thresholds tth for multiple values of roller temperature Tpr at which the pressure roller 21 operated in practice, e.g., temperatures in the range of 80° to 150° C.

In the present embodiment, the optimal threshold time tth is defined as a value with which the temperature controller can reduce the amount of overshoot OS below an allowable limit of 5 degrees while maintaining the recovery time tr at reasonably low levels.

Specifically, the determination involved experiments to measure amounts of overshoot OS and recovery time tr with varying switching time tth, followed by analyzing the experimental results to determine an optimal threshold tth for each roller temperature Tpr. The experiments were conducted with the pressure roller 21 heated to 80° C., 120° C., 150° C., and other temperatures falling within the defined temperature range, using paper recording sheets weighing 70 g/m$^2$ on which toner images had been formed in monochrome print mode.

Figure 16:
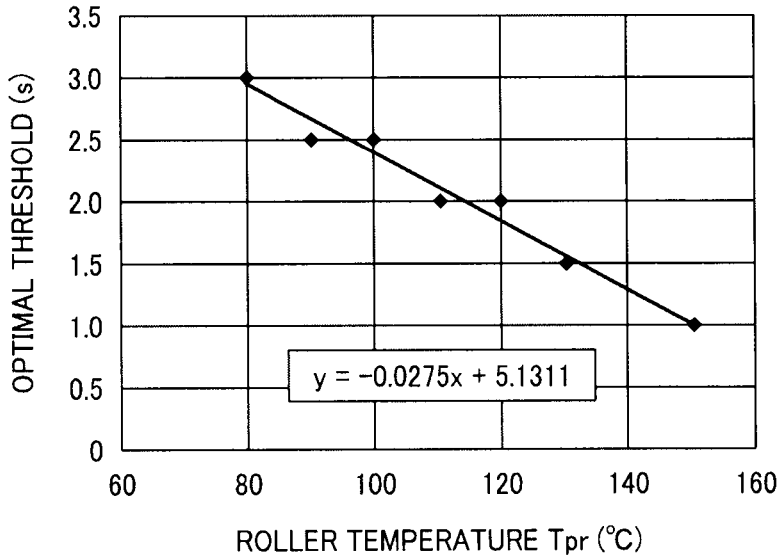
FIG. 16 is a graph plotting an optimal time threshold against a pressure roller temperature obtained from experiments in the fixing device of FIG. 6.

FIG. 16 is a graph plotting the optimal time threshold tth against the pressure roller temperature Tpr obtained from the above experiments.

As shown in FIG. 16, the optimal threshold time tth decreases approximately linearly with the roller temperature Tpr. Such a relation between tth and Tpr can be approximated by a linear function as follows:

$$tth = f(Tpr) = -0.0275Tpr + 5.1311$$

The function f(Tpr) yields an optimal switching threshold tth that can reduce the amount of overshoot OS below the 5-deg maximum limit while maintaining the recovery time tr at reasonably low levels.

Thus, the present embodiment can effectively optimize the threshold time tth by estimating the heat stored in the fixing device during standby based on the temperature Tpr of the pressure roller 21 at the start of recovery.

In a still further embodiment, the temperature controller 26 determines the threshold time tth depending on whether the image forming apparatus 1 executes a print job in the monochrome mode or in the full-color mode.

This embodiment is based on the fact that the first print time, i.e., a period of time between when a user transmits a print job (e.g., by depressing a start button) and when the image forming apparatus 1 forwards a recording sheet S to the fixing device 20 for printing a first page of the print job, is longer for full-color printing using multiple primary colors than for monochrome printing using only a single color of toner. This means that the length of recovery time tr required varies with the print mode in which a print job is executed. Thus, to ensure stable temperature control, the threshold time tth is modified to match the recovery time tr depending on the print mode of a print job executed.

Specifically, when receiving a print request from a user specifying a monochrome or full-color print mode, the temperature controller 26 enters the recovery phase Pr and determines a threshold time tth by referring to a lookup table that associates the print mode with an empirically derived optimal value for the threshold time tth. Table 2 below provides an example of such a lookup table.

TABLE 2

| | Print mode | |
|---|---|---|
| | monochrome | full-color |
| Threshold time tth [sec.] | 3 | 2 |

The lookup table as shown in Table 2 was obtained through a process similar to that depicted for the previous embodiments, involving experiments in which the fixing device was operated after a standby time ts shorter than 300 sec with the temperature controller switching from the on-off mode to the PID mode at different times during recovery to measure amounts of overshoot OS and recovery time tr for each threshold time tth, followed by analyzing the experimental results. The values in the lookup table can reduce the amount of overshoot OS below the 5-deg maximum limit while maintaining the recovery time tr at reasonably low levels.

Thus, the present embodiment can effectively optimize the threshold time tth according to the first print time dependent on the print mode of a print job executed.

In a still further embodiment, the temperature controller 26 determines the threshold time tth depending on the thickness of a paper recording sheet used to fix a toner image thereon.

This embodiment is based on the fact that the operational temperature To of the fixing device 21 varies according to the thickness of a paper sheet in use. Typically, fixing a toner image on a thick paper sheet requires a greater amount of heat than that required for fixing on a thin paper sheet, so that the operational set-point To is set at higher levels when the fixing device 20 processes thicker paper sheets. Since the recovery set-point Tr is set according to the operational set-point To, the recovery temperature Tr also varies with the thickness of a recording sheet in use. Thus, to ensure stable temperature control, the threshold time tth is modified to match the recovery set-point Tr depending on the thickness of a paper recording sheet in use.

Specifically, when receiving a print request from a user, the temperature controller 26 determines a thickness of a paper sheet in use from user-specified data or through detection by a thickness sensor. Then, the temperature controller 26 enters the recovery phase Pr and determines an optimal threshold time tth by referring to a lookup table that associates the sheet thickness with an empirically derived optimal value for the threshold time tth. Table 3 below provides an example of such a lookup table, listing ranges of paper thickness together with corresponding values of operational set-point temperature To.

TABLE 3

| | Sheet thickness w [g/m2] | | | |
|---|---|---|---|---|
| | w < 74 | 74 ≦ w < 90 | 90 ≦ w < 180 | 180 ≦ w |
| Operational set-point To [deg. C.] | 160 | 165 | 170 | 175 |
| Threshold time tth [sec.] | 1 | 1.5 | 2 | 3 |

In Table 3, the sheet thickness is represented by the weight per square metre of paper, which is often used to measure size of paper as is the weight of a ream. The lookup table as shown in Table 3 was obtained through a process similar to that depicted for the previous embodiments, involving experiments in which the fixing device was operated after being saturated with heat (i.e., after a standby time ts exceeding 300 sec) with the temperature controller switching from the on-off mode to the PID mode at different times during recovery to measure amounts of overshoot OS and recovery time tr for each threshold time tth, followed by analyzing the experimental results. The values in the lookup table can reduce the amount of overshoot OS below the 5-deg maximum limit while maintaining the recovery time tr at reasonably low levels.

Figure 17:
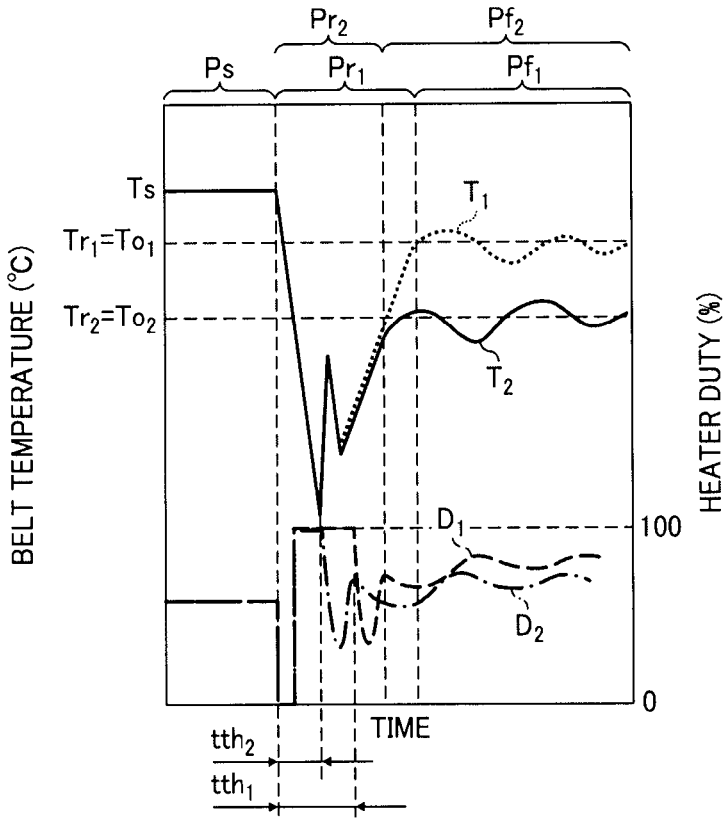
FIG. 17 is a graph showing the belt temperature and the duty cycle obtained in the fixing device of FIG. 6 when processing paper recording sheets of different thicknesses.

FIG. 17 is a graph showing the belt temperature T and the duty cycle D both plotted against time, obtained in the fixing device 20 when processing paper recording sheets of different thicknesses, in which "$T_1$" and "$D_1$" represent values for a thick paper sheet weighing 80 g/m$^2$, and "$T_2$" and "$D_2$" represent values for a thin paper sheet weighing 70 g/m$^2$.

As shown in FIG. 17, the recovery set-point Tr, which is substantially equivalent to the operational temperature To, is set at a higher level $Tr_1=To_1$ for the thick recording sheet and at a lower level $Tr_2=To_2$ for the thin recording sheet. During the recovery phase Pr, the temperature controller 26 switches from the on-off mode to the PID mode after the lapse of a relatively long threshold time $tth_1$ for the thick recording sheet, and after the lapse of a relatively short threshold time $tth_2$ for the thin recording sheet. This results in the belt temperatures $T_1$ and $T_2$ both reaching the recovery set-points $Tr_1$ and $Tr_2$, respectively, in relatively short periods of recovery time without causing an overshoot exceeding 5 degrees.

According to yet still further embodiments, the temperature controller 26 determines the threshold time tth depending on a combination of multiple factors, including the amount of heat stored in the fixing device, the print mode of a print job executed, and the thickness of a paper sheet in use, each of which can be used independently to determine the operating conditions of the fixing device as described hereinabove.

In one such embodiment, the temperature controller 26 determines the threshold time tth depending on a combination of the thickness of a paper sheet in use and the standby time ts representing the heat storage in the fixing device.

Specifically, when receiving a print request from a user, the temperature controller 26 measures a standby time ts and determines a thickness of a paper sheet in use. Then, the temperature controller 26 enters the recovery phase Pr and determines an optimal threshold time tth by referring to a lookup table associating the sheet thickness with an empirically derived optimal value for the threshold time tth, which is modified to match the specific range of standby time ts. Table 4 below provides an example of such a lookup table generated for the standby time ts ranging from 0 to 300 sec.

TABLE 4

| | Sheet thickness w [g/m2] | | | |
|---|---|---|---|---|
| | w < 74 | 74 ≦ w < 90 | 90 ≦ w < 180 | 180 ≦ w |
| Operational set-point To [deg. C.] | 160 | 165 | 170 | 175 |
| Threshold time tth [sec.] | 1 | 1.5 | 2 | 3 |

The lookup table as shown in Table 4 was derived by combining those shown in Tables 1 and 3, in which the optimal time thresholds tth for 0≦ts<300 were obtained by adding 2 sec (i.e., the difference between the two values shown in Table 1) to the values for 300≦ts as shown in Table 3. The values in the lookup table can reduce the amount of overshoot OS below the 5-deg maximum limit while maintaining the recovery time tr at reasonably low levels.

Alternatively, the temperature controller 26 may determine the threshold time tth depending on the thickness of a paper sheet in use and the temperature Tpr of the pressure roller 21 representing the heat storage in the fixing device.

Specifically, when receiving a print request from a user, the temperature controller 26 enters the recovery phase Pr and determines a temperature Tpr of the pressure roller 21 and a thickness of a paper sheet in use. The temperature controller 26 then determines a threshold time tth by calculating a predefined function tth=f(Tpr) associating the roller temperature Tpr and the optimal threshold time tth for the particular thickness of paper. The function tth=f(Tpr) for each thickness of paper was obtained through a process similar to that depicted with reference to FIG. 16.

Figure 18:
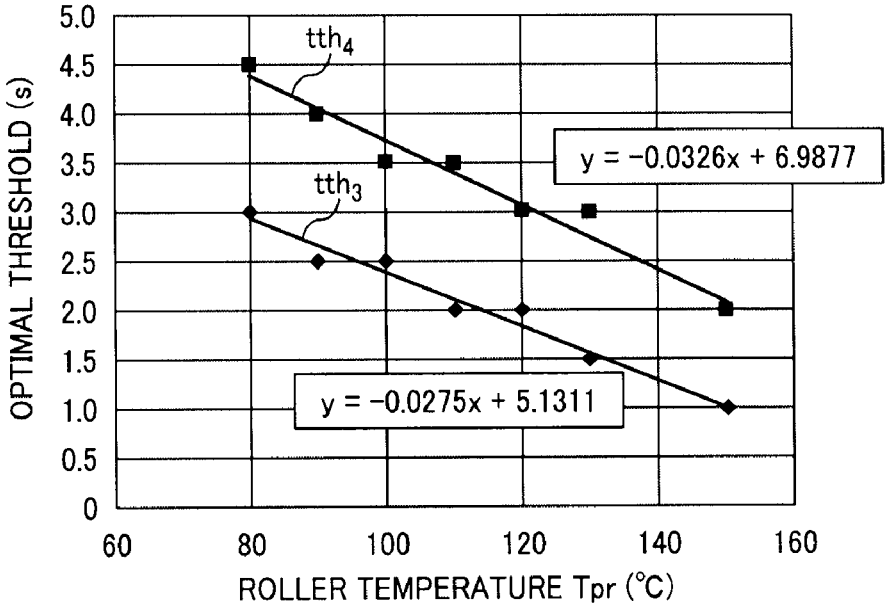
FIG. 18 is a graph showing the optimal threshold time plotted against the pressure roller temperature obtained through experiments using paper recording sheets of different thicknesses in the fixing device of FIG. 6.

FIG. 18 is a graph showing the optimal threshold time tth plotted against the pressure roller temperature Tpr obtained through experiments using paper recording sheets of different thicknesses, in which "$tth_3$" represents values for thin paper sheets weighing 70 g/m$^2$ and "$tth_4$" represents values for thick paper sheets weighing 100 g/m$^2$.

As shown in FIG. 18, the optimal time thresholds $tth_3$ and $tth_4$ both decrease approximately linearly with the roller temperature Tpr. With the roller temperature Tpr being fixed, the optimal time threshold $tth_4$ for the thick paper sheet is greater than the optimal time threshold $tth_3$ for the thin paper sheet, since the recovery set-point Tr as well as the operational temperature To for thicker recording sheets are set greater than those for thinner recording sheets (see Table 3). Such a relation between tth and Tpr can be approximated by linear functions as follows:

$$tth_3=f(Tpr)=-0.0275Tpr+5.1311$$

$$tth_4=f(Tpr)=-0.0326Tpr+6.9877$$

These functions f(Tpr) each yields an optimal switching threshold tth for each type of recording sheet, which can reduce the amount of overshoot OS below the 5-deg maximum limit while maintaining the recovery time tr at reasonably low levels.

Still alternatively, the temperature controller 26 may determine the threshold time tth depending on a combination of the print mode of a print job executed and the standby time ts representing the heat storage in the fixing device 20.

Specifically, when receiving a print request from a user specifying a monochrome or full-color print mode, the temperature controller 26 measures a standby time ts and determines a threshold time tth by referring to a lookup table associating the print mode with an empirically derived optimal value for the threshold time tth, which is modified to match the specific range of standby time ts. Table 5 below provides an example of such a lookup table generated for the standby time ts exceeding 300 sec.

TABLE 5

| | Print mode | |
|---|---|---|
| | monochrome | full-color |
| Threshold time tth [sec.] | 1 | 0.5 |

The lookup table as shown in Table 5 was derived by combining those shown in Tables 1 and 2, in which the optimal time thresholds tth for 300≦ts were set shorter than the values of tth for 0≦ts<300 as shown in Table 2, considering that the fixing device was saturated with heat after 300 sec since entering standby (see FIG. 13). The values in the lookup table can reduce the amount of overshoot OS below the 5-deg maximum limit while maintaining the recovery time tr at reasonably low levels.

Still further alternatively, the temperature controller 26 may determine the threshold time tth depending on a combination of the print mode of a print job executed and the temperature Tpr of the pressure roller 21 representing the heat storage in the fixing device.

Specifically, when receiving a print request from a user specifying a monochrome or full-color print mode, the temperature controller 26 measures a temperature Tpr of the pressure roller 21 and determines a threshold time tth by calculating a pre-defined function tth=f(Tpr) associating the roller temperature Tpr and the optimal threshold time tth for the particular print mode. The function tth=f(Tpr) for each print mode may be obtained through a process similar to that depicted with reference to FIG. 16.

Figure 19:
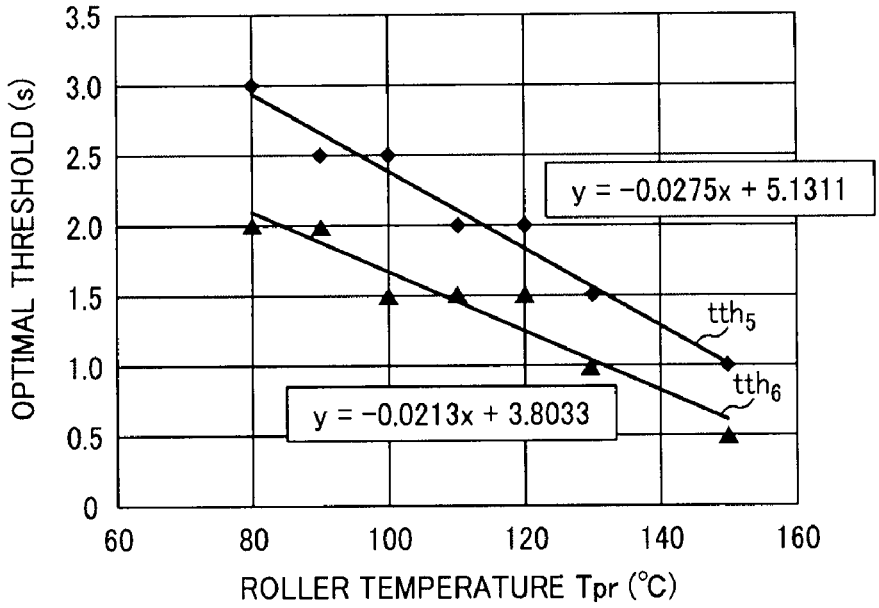
FIG. 19 is a graph showing the optimal threshold time plotted against the pressure roller temperature obtained through experiments using different print modes in the fixing device of FIG. 6.

FIG. 19 is a graph showing the optimal threshold time tth plotted against the pressure roller temperature Tpr obtained through experiments using different print modes, in which "$tth_5$" represent values for the monochrome print mode and "$tth_6$" represent values for the full-color print mode.

As shown in FIG. 19, the optimal time thresholds $tth_5$ and $tth_6$ both decrease approximately linearly with the roller temperature Tpr. With the roller temperature Tpr being fixed, the optimal time threshold $tth_6$ for the full-color mode is smaller than the optimal time threshold $tth_5$ for the monochrome mode, since the first print time for full-color printing is longer than that for monochrome printing. Such a relation between tth and Tpr can be approximated by linear functions as follows:

$$tth_5=f(Tpr)=-0.0275Tpr+5.1311$$

$$tth_6=f(Tpr)=-0.0213Tpr+3.8033$$

These functions f(Tpr) each yields an optimal switching threshold tth for each print mode, which can reduce the amount of overshoot OS below the 5-deg maximum limit while maintaining the recovery time tr at reasonably low levels.

Numerous additional modifications and variations are possible in light of the above teachings. For example, the parameters used to determine the optimal threshold time tth, including the amount of heat stored in the fixing device, the print mode of a print job executed, and the thickness of a paper sheet in use, may be used in combinations other than those depicted in the embodiments described above.

Further, although the recovery temperature Tr and the operational temperature To are set equal to each other in the embodiments described above, the temperature controller according to this patent specification is effective where the set-points Tr and To different by 5 degrees or more. This is because switching the temperature control mode based on a threshold time and not on a threshold temperature can facilitate dual-mode temperature control of a fixing device in which a monitored temperature of an unevenly heated fixing member fluctuates toward a set-point temperature.

It is therefore to be understood that, within the scope of the appended claims, the disclosure of this patent specification may be practiced otherwise than as specifically described herein.

What is claimed is:

1. An image forming apparatus, comprising:

an imaging section to form an image with toner on a recording sheet; and a thermal fixing device to fuse the toner image onto the recording sheet passing through a fixing nip, the fixing device including:

a fixing member rotatable to convey the recording sheet during fixing, a pressure member pressed against the fixing member to form the fixing nip therebetween, a heater to heat at least a portion of the fixing member, a temperature sensor to sense a temperature of the fixing member, and a temperature controller to control the temperature of the fixing member in at least one of an on-off mode and a PID mode, wherein the heater only locally heats the fixing member during standby where the fixing member stops rotation, and uniformly heats the rotating fixing member to an operational temperature during recovery where the fixing member resumes rotation in preparation for fixing, wherein the temperature controller initially operates in the on-off mode upon entering recovery, and subsequently switches to the PID mode at a threshold time elapsing after entering recovery, and wherein the temperature controller determines the threshold time at least in part according to one or more of a duration of standby, a thickness of the recording sheet, a temperature of the pressure member, and a print mode of a print job executed by a printing section.

2. The image forming apparatus according to claim 1, wherein the temperature controller determines the threshold time according to the duration of standby.

3. The image forming apparatus according to claim 1, wherein the temperature controller determines the threshold time according to the thickness of the recording sheet.

4. The image forming apparatus according to claim 1, wherein the temperature controller uses a combination of the duration of standby and the thickness of the recording sheet to determine the threshold time.

5. The image forming apparatus according to claim 1, wherein the fixing device further includes an additional temperature sensor to sense the temperature of the pressure member, and the temperature controller determines the threshold time according to the temperature of the pressure member sensed by the additional temperature sensor upon entering recovery.

6. The image forming apparatus according to claim 5, wherein the temperature controller determines the threshold time according to the temperature of the pressure member in combination with the thickness of the recording sheet.

7. The image forming apparatus according to claim 1, wherein the printing section executes the print job in one of a full-color print mode and a monochrome print mode, and the temperature controller determines the threshold time according to the print mode of the print job executed by the printing section.

8. The image forming apparatus according to claim 7, wherein the temperature controller determines the threshold time according to the print mode of the print job executed by the printing section in combination with the duration of standby.

9. The image forming apparatus according to claim 7, wherein the fixing device further includes an additional temperature sensor to sense the temperature of the pressure member, and the temperature controller determines the threshold time depending on the print mode of the print job in combination with the temperature of the pressure member sensed by the additional temperature sensor upon entering recovery.

10. The image forming apparatus according to claim 1, wherein the operational temperature is between minimum and maximum temperatures of the fixing member heated at rest during standby.

11. An image forming apparatus, comprising:

an imaging section to form an image with toner on a recording sheet; and a thermal fixing device to fuse the toner image onto the recording sheet passing through a fixing nip, the fixing device including:

a fixing member rotatable to convey the recording sheet during fixing, a pressure member pressed against the fixing member to form the fixing nip therebetween, a heater to heat at least a portion of the fixing member, a temperature sensor to sense a temperature of the fixing member, and a temperature controller to control the temperature of the fixing member in at least one of an on-off mode and a PI-D mode, wherein the heater only locally heats the fixing member during standby where the fixing member stops rotation, and uniformly heats the rotating fixing member to an operational temperature during recovery where the fixing member resumes rotation in preparation for fixing, and wherein the temperature controller initially operates in the on-off mode upon entering recovery, and subsequently switches to the PI-D mode at a threshold time elapsing after entering recovery.

12. A temperature control method for use in an image forming apparatus that incorporates a thermal fixing device to fuse a toner image onto a recording sheet passing through a fixing nip, the fixing device including: a fixing member rotatable to convey the recording sheet during fixing, a pressure member pressed against the fixing member to form the fixing nip therebetween, a heater to heat at least a portion of the fixing member, a temperature sensor to sense a temperature of the fixing member; and a temperature controller to control the temperature of the fixing member in at least one of an on-off mode and a PID mode, the method comprising:

stopping rotation of the fixing member upon entering standby;

heating the fixing member at rest only locally during standby;

resuming rotation of the fixing member upon entering recovery in preparation for fixing;

heating the rotating fixing member uniformly to an operational temperature during recovery;

switching the temperature controller from the on-off mode to the PID mode at a threshold time elapsing after entering recovery; and determining the threshold time at least in part according to one or more of a duration of standby, a thickness of the recording sheet, a temperature of the pressure member, and a print mode of a print job executed by a printing section.

* * * * *